United States Patent [19]

Yurkunas, Jr. et al.

[11] 3,967,567

[45] July 6, 1976

[54] UNITARY ADAPTOR FOR PRESSER FOOT ATTACHMENT

[75] Inventors: John A. Yurkunas, Jr., Ware; Rhea C. Lathe, Warren, both of Mass.

[73] Assignee: Wm. E. Wright Co., West Warren, Mass.

[22] Filed: Mar. 7, 1975

[21] Appl. No.: 556,383

[52] U.S. Cl. ..... 112/240

[51] Int. Cl.[2] ..... D05B 29/00

[58] Field of Search ..... 112/235, 240, 60, 61, 112/151, 150

[56] References Cited

UNITED STATES PATENTS

| | | | |
|---|---|---|---|
| 3,511,199 | 5/1970 | Howell | 112/235 |
| 3,646,899 | 3/1972 | Reynolds | 112/235 |
| 3,859,939 | 1/1975 | Howell | 112/235 |

*Primary Examiner*—Werner H. Schroeder
*Assistant Examiner*—Peter Nerbun

[57] ABSTRACT

Adaptor which fits in operative position onto a presser foot attachment of sewing machines. The adaptor has spaced resilient post members for clampingly engaging the presser foot and has on its undersurface laterally spaced parallel grooves, each having at least one inclined surface for vertically orienting a zipper coupling chain moved relative to the adaptor in the groove.

4 Claims, 6 Drawing Figures

UNITARY ADAPTOR FOR PRESSER FOOT ATTACHMENT

BACKGROUND

Sewing machines are usually provided with numerous attachments for performing various sewing operations. One such attachment is known as the "zipper foot" which is used for sewing close to the zipper coupling chain which may be in the form of individual teeth or a continuous coil. Such attachments may be positioned on either the right or the left side of the sewing needle for applying each tape of the zipper being sewn into a garment. While such attachments are suitable for use in installing conventional type zippers, they are not entirely satisfactory for use in sewing in the so-called "invisible zipper" where the opposed edges of the garment opening to which the zipper is being applied are disposed so close together as to overlie the zipper and make it practically invisible. To apply such invisible zippers, which at the present time usually have continuous synthetic plastic coupling chains in the form of interlocking coils, it is desirable to sew the stitches along a line as close as possible to the zipper coil. To do this properly, each coupling coil is oriented upright, usually horizontal along the edge of the zipper tape, and in this position stitches can be sewn along a line almost abutting the coil itself. Conventional zipper foot attachments are not suitable to achieve this type of zipper installation.

The principal object of this invention is to provide an effective, inexpensive unitary adaptor which can be readily fitted onto various presser foot attachments provided as accessories for the leading commercial sewing machine models currently available on the market.

The above and other objects and advantages will be more readily apparent from the following disclosure and with reference to the accompanying drawings, in which.

Figure 1:
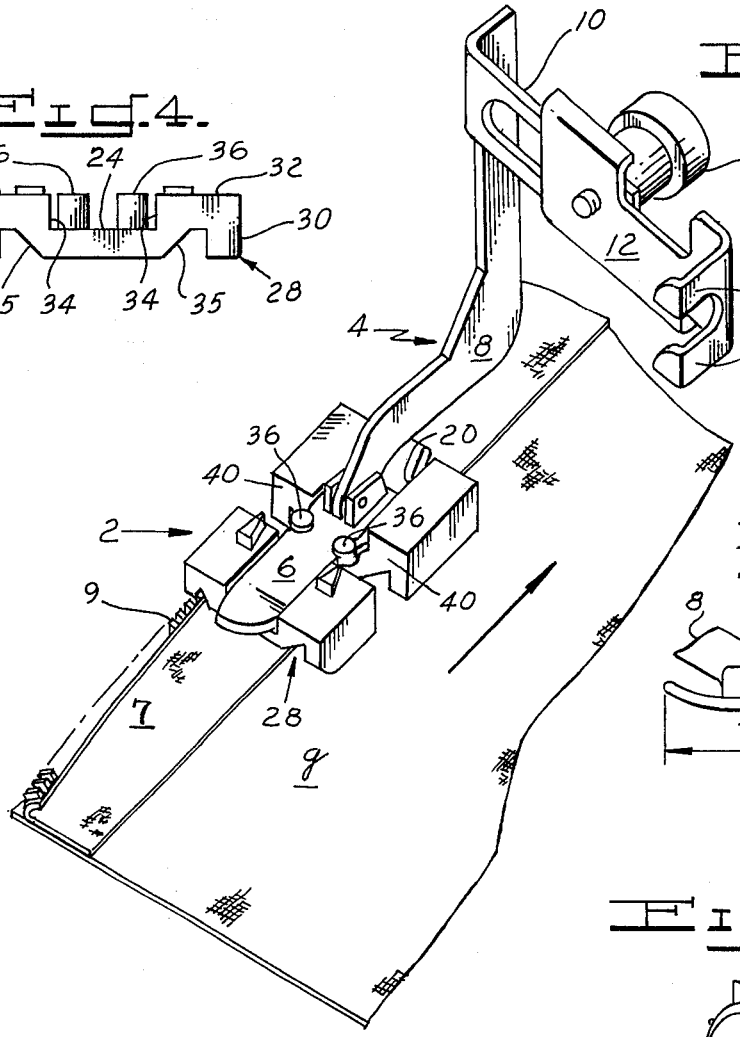
FIG. 1 is an overall perspective view showing the adaptor in use.

Referring in detail to the drawings, an adaptor 2 embodying this invention is shown in FIG. 1 fitted onto a presser foot attachment consisting of the presser foot 6 connected to an angled support or leg member 8. A cross arm 10 with an elongated slot extends normal to the plane of the leg 8 and slidably receives a mounting bracket 12 from which extends a forked angled mounting member 14 for attachment to the needle clamp of a sewing machine. The bracket 12 is adjustable for movement of the leg 8 relative to the sewing machine needle so that the foot 6 can be disposed to the right or left of the needle for sewing the two sides of a zipper tape, such as shown at 7 in FIG. 1. A knurled set screw 16 is provided to secure the bracket 12 in place on the arm 10 for any selected position of the foot 6 relative to the reciprocal path of the sewing machine needle.

Figure 2:
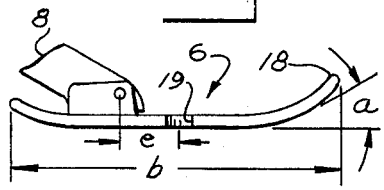
FIG. 2 is a side elevational view of a presser foot illustrating the characteristics of the presser foot widely in use today.

The presser foot 6 includes an upwardly curved tip portion 18, FIG. 2, and a pair of oppositely disposed recesses 19 on the side edge portions of the presser foot. The side edges of the tip 18 of the presser foot are also smoothly curved to urge the zipper teeth or coil element, as shown at 9 in FIG. 1, clear of the sewing line as the tape is advanced from the toe to the heel of the zipper foot. The presser foot has an overall length *b* and its tip portion extends upwardly at angle *a* from the bottom surface thereof. The recesses 19 are located somewhat forward of the pivotal mounting of the foot of the leg 8. The pivot point, as best seen in FIG. 2, is located aft of the geometric center of the presser foot so that the curved tip portion of the presser foot tends to lift slightly to plane easily over an advancing zipper tape 7, thus serving to press down and hold the tape flat as it is moved under the foot in sewing. When a tape is being sewn in a garment *g*, shown in FIG. 1 but with the adaptor 2 omitted, the foot is pressed downwardly by the leg 8 at the pivot point and the needle penetrates the zipper tape just forward of the pivot at the recesses 19.

It is contemplated that a conventional type zipper foot attachment provided with sewing machines may be utilized in the customary manner for applying zippers. In accordance with this invention, when it is desired to properly install an invisible zipper, the same attachment is to be used and the adapter 2 snap-fitted onto the zipper foot so that the invisible zipper will be sewn into a garment opening with the line of stitches located closely adjacent the fastener chain of the zipper.

Figure 3:
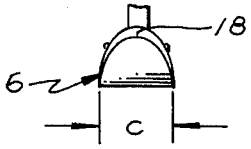
FIG. 3 is a front elevational view of the front of the presser foot shown in FIG. 2.

In accordance with this invention, the adaptor, shown generally at 2, may be removably snapped in place onto various presser foot attachments currently available on the market as one of the accessories provided with the leading sewing machine models. The adaptor is constructed so that the presser foot 6 will serve as the mounting pedestal or base for the adaptor. The adaptor, as shown, comprises an integral plastic member of generally overall rectangular configuration. The upper surface of the adaptor includes a longitudinally extending recess 20 slightly greater in width than the width *c* (FIG. 3) of the presser foot 6. It has been found that the variation in width *c* from the smallest to the largest available presser foot is about 0.120 inch and the adaptor embodying this invention may be constructed in different sizes to fit such size variations or may be of sufficient width and resilience so that one adaptor will fit different size attachments.

Figure 6:
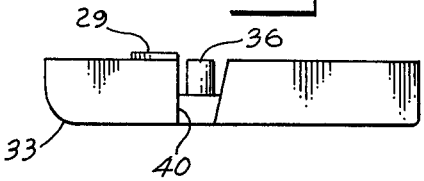
FIG. 6 is a side elevational view of the adaptor.

The bottom of the recess 20 is in the form of a relatively thin web 24 which extends from a guide channel 28 disposed along one side edge of the adaptor to an identical guide channel 28 disposed along the other side. Extending longitudinally through the web is a slot 22, the ends of which terminate adjacent the front and back ends of the adaptor in openings of generally circular cross section. Each guide channel includes an upstanding beam or riser portion 30, a horizontal land 32 and a downwardly extending shoulder 34 which meets the upper surface of the web 24 and defines the outer marginal edges of the central recess 20. The undersurface of the thin web 24 is flat and generally coplanar with the bottom edge surfaces of the upright beams 30. The leading lower edge 33, FIG. 6, of the adaptor is smoothly curved so as to facilitate movement of fabric zipper tapes under the adaptor which is urged downwardly against the advancing tape. This arrangement provides a smooth flat surface which slides easily over the zipper tape. In this connection, the adaptor is preferably fabricated of a material having a low coefficient of friction on zipper tape materials.

Figure 5:
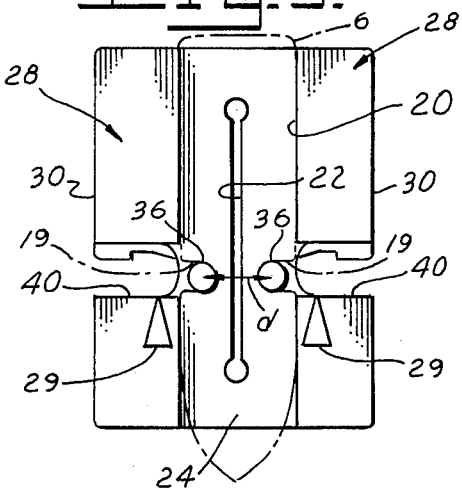
FIG. 5 is a plan view of the adaptor.

The adaptor includes a pair of oppositely disposed U-shaped recesses 40 extending laterally through the two guide channels 28. Each recess 40 terminates adjacent the outer surfaces of upstanding posts 36. As best shown in FIGS. 1 and 5, the recesses 40 are generally in lateral alignment with the posts 36 and the recesses 19 in the presser foot.

Retaining means for holding the adaptor in place on the presser foot 6 comprises the upstanding posts or pins 36 of generally circular cross section. Each post extends vertically from the upper surface of the web 24 to a suitable height which, in the illustrated embodiment, is approximately at the same level as the land 32. The diameter of the retaining posts and the spacing *d* therebetween are selected so that the opposed inner surface portions of the posts fit within the recesses 19 of the presser foot and snugly engage the same in surface-to-surface contact. The distance *d* between the two posts is made less than the corresponding distance measured from center-to-center between the two opposed recesses 19 so that when the adaptor is fitted onto the foot 6, the posts 36 will be deflected outwardly. Because of the resilient character of the material which forms the adaptor, the posts will be tensioned in clamping relation within the recess 19. In addition to the posts 36, the corresponding half portions of the web 24, separated by the slot 22, cooperate in permitting outward flexure of the upper ends of the posts without danger of shearing or fracture of the posts at the surface of the web 24. The deflection imparted to each post is in effect distributed to the portion of the web 24 from which it extends. In effect, the approximate half web portion on each side of the slot 22 serves as a spring member from which the posts 36 extend. Outward force applied to the posts 36 will result in flexure of the web centered at the slot 22.

Figure 4:
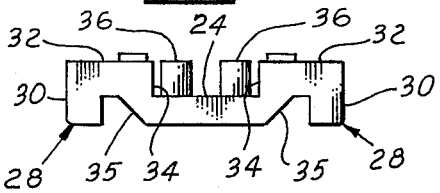
FIG. 4 is an end elevational view of an adaptor of the type embodying this invention.

Each guide channel 28 opens downwardly, as best shown in FIG. 4, and is adapted to guide the fastener coil elements, as represented at 9 in FIG. 1, along a straight line for sewing. The upper surface of the adaptor is provided with indicia 29 to aid in alignment of the adaptor and the sewing machine needle in position for proper zipper installation. Each channel 28 is generally of right triangular cross section with truncated apex. The outer wall of the channel is generally perpendicular to the plane of the bottom of the adaptor and the inner wall is inclined at a substantial oblique angle to the bottom, as best seen at 35 in FIG. 4.

Preliminary to the use of the adaptor the zipper is generally pinned or basted into the garment at the desired location. The presser foot is mounted on the sewing machine and the adaptor 2 snapped in place on the foot 6, as shown in FIG. 1. The arm 10 is adjusted to properly position one guide channel 28 so that the adaptor web 24 is resting on the tape 7 with the inclined surface 35 of the guide channel engaged with the inner edge of the fastener coil or chain. At the start of the sewing operation, the coil is manipulated to an upright position in the channel 28 and sewing is commenced with the sewing machine needle aligned with the appropriate index mark 29. As the slide fastener tape 7 and the garment *g*, in which it is being installed, are advanced together in the sewing direction illustrated by the arrow in FIG. 1, the fastener coil or chain 9 will be continuously and automatically deflected or oriented upwardly upon entering the channel 28. Thus the fastener coil is maintained generally normal to the plane of the tape during stitching. With the coil held upright in this manner, the sewing machine needle is afforded maximum clearance to penetrate the tape 7 as close as possible to the coil 9. The sewing machine needle enters the cutout or U-shaped recess 40 in approximate alignment with one of the indicia 29.

The adaptor constructed in accordance with this invention has been found to have excellent positional stability relative to the workpiece or tape as the latter is moved therepast during sewing. This stability is attained by the longitudinal positioning of the retaining post 36 forward of the geometric center of the adaptor approximately the same as the distance *e* (FIG. 2) by which the recessses 19 are offset longitudinally from the pivotable connection of the foot 6 to the leg 8. As a consequence, the pivot or pressure point of the leg 8 is located at approximately the geometric center of the adaptor which is thus urged uniformly against the workpiece. Consequently, despite the simple construction of the retaining means provided, the adaptor is invariably held firmly and securely in operative position against an advancing workpiece during sewing. There is, moreover, minimal tendency for the adaptor to swerve right or left or pitch vertically so as to bind or gather the fabric of the workpiece. As a consequence, an adaptor embodying this invention is wholly effective to guide a zipper coil or chain in a proper upright position for sewing while at the same time effectively retaining the tape in flat condition for ease of machine sewing along a line closely adjacent a coupling coil.

Having thus described this invention, what is claimed is:

1. Adaptor for installing invisible type slide fasteners for use in combination with sewing machine presser foot attachments having a foot portion with spaced opposed recesses in the side edges thereof for accommodating reciprocable movement of a sewing machine needle when installing slide fasteners of non-invisible type without said adaptor, said adaptor being integrally formed of a resilient material and having a pair of laterally spaced, longitudinally extending, downwardly opening guide channels for receiving and guiding the coupling element chain of a slide fastener, said channel including an inclined surface engageable with the coupling chain to orient the same upright with respect to the tape of the slide fastener, and retaining means comprising laterally spaced post members extending upwardly from the adaptor and being laterally spaced apart a distance less than the distance between said opposed recesses, said post members having a cross sectional configuration to fit within said spaced opposed recesses in the side edges of said foot and being deflected apart or releasably fitting into said recesses and thereby resiliently gripping said presser foot to retain said adaptor in fixed position on said attachment.

2. Adaptor for installing invisible type slide fasteners as set forth in claim 1, in which said adaptor is formed of synthetic plastic material and includes a web having a height substantially less than that of said guide channels, thereby forming an upwardly opening recess, said retaining means being in the form of at least one pair of posts extending from the upper surface of said web in laterally spaced relation, at least one slot through said web extending longitudinally of the adaptor between said posts and terminating adjacent the opposite ends of said adaptor, said slot dividing said web into deflectable spring portions from which said posts extend.

3. Adaptor for installing invisible type slide fasteners as set forth in claim 2, in which each channel includes an inner surface inclined at an oblique angle to the bottom surface of said web for deflecting to an upright position the coupling elements of a slide fastener moved longitudinally through said channel during sewing, each channel having a slot extending laterally therethrough and communicating with said channel to provide access for the sewing machine needle to a tape disposed in the channel, said lateral slots being disposed generally in transverse alignment with said posts.

4. Adaptor for installing invisible type slide fasteners as set forth in claim 2, in which the foot portion of said attachment is pivotably supported at a given distance longitudinally from said recesses, said posts being offset from the longitudinal center of said adaptor by a distance approximately the same as the distance by which said recesses are located from the pivotable support of said presser foot whereby said pivotable support is disposed approximately at the geometric center of said adaptor.

* * * * *